US009365781B2

(12) United States Patent
Dindi

(10) Patent No.: US 9,365,781 B2
(45) Date of Patent: Jun. 14, 2016

(54) PROCESS FOR DIRECT HYDROGEN INJECTION IN LIQUID FULL HYDROPROCESSING REACTORS

(75) Inventor: Hasan Dindi, Wilmington, DE (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 65 days.

(21) Appl. No.: 13/480,574

(22) Filed: May 25, 2012

(65) Prior Publication Data

US 2013/0313161 A1 Nov. 28, 2013

(51) Int. Cl.
*C10G 65/02* (2006.01)
*C10G 49/00* (2006.01)

(52) U.S. Cl.
CPC ..... *C10G 65/02* (2013.01); *C10G 49/002* (2013.01); *C10G 2300/802* (2013.01)

(58) Field of Classification Search
CPC ..... C10G 65/00; C10G 65/02; C10G 65/04; C10G 65/10; C10G 65/12; C10G 45/22; C10G 2300/802; C10G 49/002
USPC ..... 208/49, 100, 59, 89, 97, 264
See application file for complete search history.

(56) References Cited

U.S. PATENT DOCUMENTS

| | | | |
|---|---|---|---|
| 3,617,524 | A | 11/1971 | Conn |
| 3,652,450 | A | 3/1972 | Boyd |
| 3,652,451 | A | 3/1972 | Boyd |
| 3,697,416 | A | 10/1972 | Carson et al. |
| 4,182,741 | A | 1/1980 | Carson et al. |
| 5,252,198 | A | 10/1993 | Harrison et al. |
| 6,123,835 | A | 9/2000 | Ackerson et al. |
| 6,299,759 | B1 | 10/2001 | Bradway et al. |
| 6,428,686 | B1 | 8/2002 | Ackerson et al. |
| 6,517,706 | B1 | 2/2003 | Pruden et al. |
| 6,824,675 | B2 | 11/2004 | Boyer et al. |
| 6,881,326 | B2 | 4/2005 | Ackerson et al. |
| 7,238,329 | B2 | 7/2007 | Boyer et al. |

(Continued)

FOREIGN PATENT DOCUMENTS

| | | | |
|---|---|---|---|
| CN | 1324917 | A | 12/2001 |
| CN | 1382774 | A | 12/2002 |

(Continued)

OTHER PUBLICATIONS

Injecting, (n.d.) American Heritage® Dictionary of the English Language, Fifth Edition (2011), retrieved Sep. 15, 2015, from http://www.thefreedictionary.com/injecting.*

(Continued)

*Primary Examiner* — Prem C Singh
*Assistant Examiner* — Brandi M Doyle

(57) ABSTRACT

A process of hydroprocessing a hydrocarbon in a down flow reactor comprising one or more hydroprocessing-catalyst beds. The hydrocarbon feed is mixed with hydrogen and optionally diluent to form a liquid feed mixture wherein hydrogen is dissolved in the mixture, and the liquid feed mixture is introduced into the down flow reactor under hydroprocessing conditions. The hydroprocessing-catalyst bed(s) are liquid-full and the feed reacts by contact with the catalyst. Hydrogen gas is injected into at least one of the hydroprocessing-catalyst beds such that at least part of the hydrogen consumed in that bed is replenished and the liquid-full condition is maintained. In a multi-bed reactor, hydrogen gas may be injected into more than one or all of the hydroprocessing-catalyst beds.

19 Claims, 2 Drawing Sheets

(56) References Cited

U.S. PATENT DOCUMENTS

| | | | | |
|---|---|---|---|---|
| 7,569,136 | B2 | 8/2009 | Ackerson et al. | |
| 2002/0074262 | A1 | 6/2002 | Gupta | |
| 2005/0035026 | A1 | 2/2005 | Espinoza et al. | |
| 2006/0144756 | A1 * | 7/2006 | Ackerson et al. | 208/108 |
| 2007/0241212 | A1 | 10/2007 | Kilroy | |
| 2009/0095651 | A1 * | 4/2009 | Leonard et al. | 208/49 |
| 2009/0321319 | A1 * | 12/2009 | Kokayeff et al. | 208/164 |
| 2009/0326289 | A1 * | 12/2009 | Petri | C10G 49/26 585/263 |
| 2012/0004479 | A1 | 1/2012 | Hanks et al. | |
| 2012/0273391 | A1 | 11/2012 | Dindi et al. | |

FOREIGN PATENT DOCUMENTS

| | | | |
|---|---|---|---|
| CN | 101338220 | A | 1/2009 |
| CN | 101358146 | A | 2/2009 |
| CN | 101768468 | A | 7/2010 |
| JP | 2009-001823 | A | 1/2009 |
| WO | 03/042333 | A1 | 5/2003 |
| WO | 2008/014150 | A2 | 1/2008 |

OTHER PUBLICATIONS

ASTM D4294, Standard Test Method for sulfur in Petroleum and Petroleum Products by Energy Dispersive X-ray Fluorescence Spectrometry, 2008, ASTM International, West Conshohocken, Pennsylvania.

ASTM D7220, Standard Test Method for Sulfur in Automotive Fuels by Polarization X-ray Fluorescence Spectrometry, 2006, ASTM International, West Conshohocken, Pennsylvania.

ASTM D4629, Standard Test Method for Trace Nitrogen in Liquid Petroleum Hydrocarbons by Syringe/Inlet Oxidative Combustion and Chemiluminescence Detection, 2007, ASTM International, West Conshohocken, Pennsylvania.

ASTM D5762, Standard Test Method for Nitrogen in Petroleum and Petroleum Products by Boat-Inlet Chemiluminescence, 2005, ASTM International, West Conshohocken, Pennsylvania.

ASTM D5186, Standard Test Method for Determination of the Aromatic Content and Polynuclear Aromatic Content of Diesel Fuels and Aviation Turbine Fuels by Supercritical Fluid Chromatography, 2009, ASTM International, West Conshohocken, Pennsylvania.

ASTM D2887, Standard Test Method for Boiling Range Distribution of Petroleum Fractions by Gas Chromatography, 2008, ASTM International, West Conshohocken, Pennsylvania.

ASTM D86, Standard Test Method for Distillation of Petroleum Products at Atmospheric Pressure, 2009, ASTM International, West Conshohocken, Pennsylvania.

ASTM D4052, Standard Test Method for Density, Relative Density, and API Gravity of Liquids by Digital Density Meter, 2009, ASTM International, West Conshohocken, Pennsylvania.

ASTM D1159, Standard Test Methods for Bromine Numbers of Petroleum Distillates and Commercial Aliphatic Olefins by Electrometric Titration.

ASTM D4737, Standard Test Method for Calculated Cetane Index by Four Variable Equation, 2009, ASTM International, West Conshohocken, Pennsylvania.

ASTM D1218, Standard Test Method for Refractive Index and Refractive Dispersion of Hydrocarbon Liquids, 2007, ASTM International, West Conshohocken, Pennsylvania.

Alvarez, Anton et al, Comparison of Quench Systems in Commercial Fixed-Bed Hydroprocessing Reactors, Energy & Fuels, 2007, pp. 1133-1144, vol. 21, American Chemical Society.

Alvarez, Anton et al., Effect of Liquid Quenching on Hdroprocessing of Heavy Crude Oils in a Fixed-Bed Reactor System, Ind. Eng. Chem. Res. 2009, pp. 1228-1236, vol. 48, American Chemical Society.

PCT International Search Report and Written Opinion mailed Aug. 21, 2013.

* cited by examiner

PROCESS FOR DIRECT HYDROGEN INJECTION IN LIQUID FULL HYDROPROCESSING REACTORS

FIELD OF THE INVENTION

The present invention pertains to a process of two phase ("liquid full") hydroprocessing of a hydrocarbon in a down flow reactor with one or more hydroprocessing-catalyst beds.

BACKGROUND OF THE INVENTION

Hydroprocessing such as hydrodesulfurization, hydrodenitrogenation, hydrodeoxygenation, hydrodemetallation, hydrodearomatization, dewaxing, hydroisomerization, and hydrocracking, is important commercially to upgrade crude hydrocarbon feedstocks. For example, hydrodesulfurization (HDS) and hydrodenitrogenation (HDN), are used to remove sulfur and nitrogen, respectively, and produce clean fuels.

Conventional hydroprocessing processes use trickle bed reactors in which hydrogen is transferred from a vapor phase through a liquid phase hydrocarbon feed to react with the feed at the surface of a solid catalyst. Thus, three phases (gas, liquid and solid) are present. Trickle bed reactors are expensive to operate and require large quantities of hydrogen, much of which must be recycled through expensive hydrogen compressors. Heat removal from the highly exothermic hydroprocessing processes is inefficient. Significant coke forms on the surfaces of catalysts in trickle bed reactors, causing catalyst deactivation.

U.S. Pat. No. 6,123,835 discloses a two-phase hydroprocessing system which eliminates the need to circulate hydrogen through the catalyst. In the two-phase hydroprocessing system, a solvent or a recycled portion of hydroprocessed liquid effluent acts as diluent and is mixed with a hydrocarbon feed. Hydrogen is dissolved in the feed/diluent mixture to provide hydrogen in the liquid phase. All of the hydrogen required in the hydroprocessing reaction is available in solution.

Two-phase hydroprocessing systems contain a single liquid recycle stream to increase dissolved hydrogen availability throughout a reactor. The recycle stream eliminates hydrogen gas recirculation through the catalyst and provides a heat sink for a uniform temperature distribution. However recycle has disadvantages. Recycle introduces back-mixing to the system, which reduces conversion, for example, sulfur removal efficiency. Back-mixing reduces catalyst efficiency because reaction products, such as hydrogen sulfide and ammonia, which are present in the recycle stream take up the catalyst active sites. This causes difficulty in competing with conventional trickle bed reactors, which do not have liquid recycle, in kinetically limited regions, i.e., reducing sulfur below 10 ppm for ULSD. By "kinetically limited region", it is meant herein where organic sulfur concentration is very low (such as around 10-50 ppm). The reaction rate of organic sulfur conversion is reduced, kinetically limited, at such low sulfur concentrations in the presence of recycle, which includes reaction products.

It would be desirable to have, and the present invention aims to provide, a two-phase hydroprocessing systems which reduces or eliminates the need for a recycle stream and allows increased sulfur and nitrogen conversions.

U.S. Pat. No. 6,428,686 claims a hydroprocessing process comprising combining a liquid feed with reactor effluent and flashing with hydrogen, then separating any gas from the liquid upstream of the reactor and then contacting the feed/effluent/hydrogen mixture with a catalyst in the reactor, removing the contacted liquid from the reactor at an intermediate position, combining the removed liquid with hydrogen gas to resaturate with hydrogen, separating the gas from the liquid and reintroducing the removed liquid back into the reactor at the point the removed liquid was withdrawn.

U.S. Pat. No. 6,881,326 claims a hydroprocessing process comprising combining a liquid feed with reactor effluent and hydrogen so that the hydrogen is dissolved to form a substantially hydrogen-gas-free liquid feed stream and then contacting the liquid feed stream with a catalyst in the reactor with substantially no excess hydrogen gas present removing the contacted liquid from the reactor at an intermediate position combining the removed liquid with hydrogen so that hydrogen is dissolved within the removed liquid and reintroducing the removed liquid back into the reactor.

U.S. Pat. No. 7,569,136 discloses a continuous liquid phase hydroprocessing process. In one embodiment, a down flow two-reactor system is described wherein feed, recycled reacted product and hydrogen are combined in a first mixer and the first mixture flows to a first reactor; the product from the first reactor is combined with hydrogen in a second mixer and the second mixture flows to a second reactor. In another embodiment a down flow multi-bed reactor system is described wherein feed, recycled reacted product and hydrogen are combined in a first mixer and the first mixture flows into the reactor and through a first catalyst bed; the product from the first reactor is combined with hydrogen in a second mixer and the second mixture flows to a second catalyst bed.

Although processes are known for liquid phase hydroprocessing, there remains a need for improvements, for example, higher conversions with less back mixing. The present invention meets this need.

SUMMARY OF THE INVENTION

The present invention provides a process which involves mixing and dissolving hydrogen in a hydrocarbon feed upstream of a reactor and also injecting hydrogen gas into one or more of the catalyst beds to replenish hydrogen consumed in the hydroprocessing reaction and at the same time maintain a substantially liquid-full condition in that/those bed(s). More particularly, the present invention is a hydroprocessing process comprising: (a) providing a down flow reactor comprising one or more hydroprocessing-catalyst beds and providing when two or more hydroprocessing-catalyst beds are present that said beds are disposed in sequence and in liquid communication; (b) contacting a hydrocarbon feed with hydrogen and optionally diluent to form a liquid feed mixture wherein hydrogen is dissolved in the mixture; (c) introducing said liquid feed mixture into the down flow reactor under hydroprocessing conditions; (d) reacting the liquid feed mixture by contact with the one or more hydroprocessing-catalyst beds, wherein each of said one or more hydroprocessing-catalyst beds is substantially liquid-full; and (e) injecting hydrogen gas into at least one of the one or more hydroprocessing-catalyst beds at a controlled rate such that at least part of the hydrogen consumed in each bed by the hydroprocessing reaction is replenished and the substantially liquid-full condition in each hydroprocessing-catalyst bed is maintained.

The number of hydroprocessing-catalyst beds in the down-flow reactor is not limited and includes, for example, one, two, three, or four beds. Hydrogen gas must be injected into at least one of the hydroprocessing-catalyst beds but may be injected into more than one or all of the hydroprocessing-catalyst beds when the reactor comprises a plurality of beds.

The hydrocarbon feed to be hydroprocessed may comprise diluent which may be recycled effluent from one of the hydroprocessing-catalyst beds. When diluent is present, the volume ratio of diluent-to-liquid hydrocarbon feed may be less than about 5, preferably less than 1 and more preferably less than 0.5.

In one embodiment of the present invention, excess gas is vented from a headspace above at least one, more than one, or all of hydroprocessing-catalyst beds into which hydrogen gas was injected. Gas vents for venting of excess gas may be positioned in the headspace above any or all of the hydroprocessing-catalyst beds and may include one or a plurality of such vents in each headspace.

In another embodiment of the present invention, the controlled rate of hydrogen gas injected into at least one of the one or more hydroprocessing-catalyst beds is adjusted based on the amount of hydrogen gas determined to be in a headspace above the hydroprocessing-catalyst bed(s) in which the hydrogen injection occurs. The rate of hydrogen injection into a bed may be controlled to maximize the amount of hydrogen available in solution for hydroprocessing and minimize or eliminate the amount hydrogen in excess of the solubility limit which escapes into the headspace as gas.

Surprisingly, by injecting hydrogen directly into the bed, higher conversion (for example, of sulfur, nitrogen, aromatics) can be achieved relative to exclusively feeding hydrogen into the feed in advance of the reactor.

DETAILED DESCRIPTION

Figure 1:
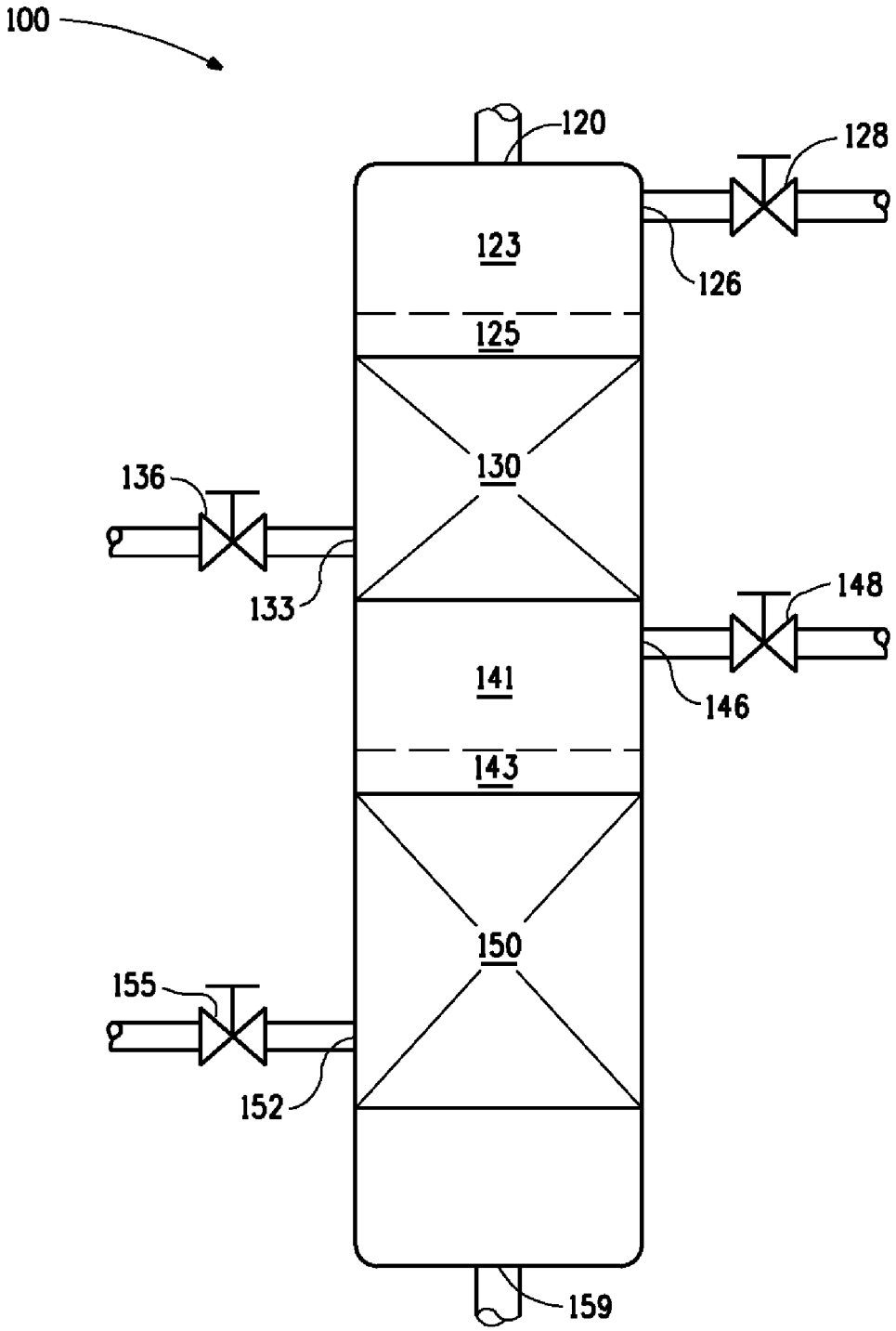
FIG. 1 illustrates a down flow reactor suitable for use in one embodiment of this invention comprising two liquid-full hydroprocessing-catalyst beds.

"Hydroprocessing" as used herein means any process that is carried out in the presence of hydrogen, including, but not limited to, hydrogenation, hydrotreating, hydrodesulfurization, hydrodenitrogenation, hydrodeoxygenation, hydrodemetallation, hydrodearomatization, dewaxing, hydroisomerization, and hydrocracking.

The reactor prescribed by the present invention can be any suitable reactor known in the art for continuous processing in a down flow mode, for example, a plug flow or tubular reactor. The reactor is equipped with one or more hydroprocessing-catalyst beds. In multi-bed reactors, the beds are disposed in sequence and in liquid communication. The hydroprocessing-catalyst beds, as the name implies, are comprised of hydroprocessing-catalyst. The catalyst is fixed in place in the bed, in other words a fixed-bed catalyst.

The number of beds in the reactor may be based on practical considerations such as controlling cost and complexity in this hydroprocessing zone. One or more catalyst beds as prescribed herein may be, for example, one to ten beds or two to four beds. The reactor prescribed by the present invention includes, for example, reactors with one, two, three and four hydroprocessing-catalyst beds.

When more than one catalyst bed is present, either within a single reactor, or in multiple reactors, each catalyst bed having a catalyst volume, the catalyst volume may increase with each succeeding bed in order to obtain equal hydrogen consumption in each catalyst bed. Thus, the catalyst volume of the first catalyst bed, in such embodiment is smaller than the catalyst volume of the second catalyst bed, and so on, if more than two catalyst beds are present.

The catalyst may be a hydrotreating catalyst or hydrocracking catalyst. By "hydrotreating", it is meant herein a process in which a hydrocarbon feed reacts with hydrogen for the removal of heteroatoms, such as sulfur, nitrogen, oxygen, metals, asphaltenes, and combinations thereof, or for hydrogenation of olefins and/or aromatics, in the presence of a hydrotreating catalyst. By "hydrocracking", it is meant herein a process in which a hydrocarbon feed reacts with hydrogen for the breaking of carbon-carbon bonds to form hydrocarbons of lower average boiling point and/or lower average molecular weight than the starting average boiling point and average molecular weight of the hydrocarbon feed, in the presence of a hydrocracking catalyst. Hydrocracking also includes ring opening of naphthenic rings into more linear-chain hydrocarbons.

A hydrotreating catalyst comprises a metal and an oxide support. The metal is a non-precious metal selected from the group consisting of nickel, cobalt, and combinations thereof, preferably combined with molybdenum and/or tungsten. The hydrotreating catalyst support is a mono- or mixed-metal oxide, preferably selected from the group consisting of alumina, silica, titania, zirconia, kieselguhr, silica-alumina zeolite and combinations of two or more thereof.

A hydrocracking catalyst also comprises a metal and an oxide support. The metal is also a non-precious metal selected from the group consisting of nickel, cobalt, and combinations thereof, preferably combined with molybdenum and/or tungsten. The hydrocracking catalyst support is a zeolite, amorphous silica, alumina, or a combination thereof.

The catalysts of the present invention may comprise a combination of metals selected from the group consisting of nickel-molybdenum (NiMo), cobalt-molybdenum (CoMo), nickel-tungsten (NiW) and cobalt-tungsten (CoW) and combinations thereof.

Catalysts for use in the present invention may further comprise other materials including carbon, such as activated charcoal, graphite, and fibril nanotube carbon, as well as calcium carbonate, calcium silicate and barium sulfate.

Catalysts for use in the present invention include known commercially available hydroprocessing catalysts. Although the metals and supports may be similar or the same, catalyst manufacturers have the knowledge and experience to provide of formulations for either hydrotreating catalysts or hydrocracking catalysts. More than one type of hydroprocessing catalyst may be used in the hydroprocessing reactor.

Preferably, the catalyst is in the form of particles, more preferably shaped particles. By "shaped particle" it is meant the catalyst is in the form of an extrudate. Extrudates include cylinders, pellets, or spheres. Cylinder shapes may have hollow interiors with one or more reinforcing ribs. Trilobe, quadralobe, cloverleaf, rectangular- and triangular-shaped tubes, cross, and "C"-shaped catalysts may be used. Preferably a shaped catalyst particle is about 0.25 to about 13 mm (about 0.01 to about 0.5 inch) in diameter when a packed bed reactor is used. More preferably, a catalyst particle is about 0.79 to about 6.4 mm (about 1/32 to about 1/4 inch) in diameter. Such catalysts are commercially available.

The catalysts may be sulfided by contacting a catalyst with a sulfur-containing compound at an elevated temperature and in the presence of hydrogen. Suitable sulfur-containing compound include thiols, sulfides, disulfides, $H_2S$, or combinations of two or more thereof. By "elevated temperature" it is meant, greater than 230° C. (450° F.) to 340° C. (650° F.). The catalyst may be sulfided before use ("pre-sulfiding") or during the process.

A catalyst may be pre-sulfided ex situ or in situ. A catalyst is pre-sulfided ex situ by contacting the catalyst with a sulfur-containing compound outside of a catalyst bed—that is, outside of the hydroprocessing unit comprising the two-phase and three-phase hydroprocessing zones. A catalyst is pre-sulfided in situ by contacting the catalyst with a sulfur-containing compound in a catalyst bed (i.e., within the hydroprocessing unit comprising the two-phase and three-phase hydroprocessing zones). Preferably, the catalysts of the two-phase and the three-phase hydroprocessing zones are pre-sulfided in situ.

A catalyst may be sulfided during the process by periodically contacting the feed or diluent with a sulfur-containing compound prior to contacting the liquid feed with the first catalyst.

The hydrocarbon feed is contacted with hydrogen gas and optionally a diluent prior to being introduced into the reactor to provide a feed/hydrogen mixture or a feed/diluent/hydrogen mixture, which is the liquid feed mixture. The contacting operation to make the liquid feed mixture may be performed in any suitable mixing apparatus known in the art.

The hydrocarbon feed may be any hydrocarbon composition containing undesirable amounts of contaminants (sulfur, nitrogen, metals) and/or aromatics. The hydrocarbon feed may have a viscosity of at least 0.3 cP, a density of at least 750 kg/m3 at temperature of 15.6° C. (60° F.), and an end boiling point in the range of from about 200° C. (390° F.) to about 700° C. (1300° F.). The hydrocarbon feed may be mineral oil, synthetic oil, petroleum fractions, oil-sands fractions, or combinations of two or more thereof. Petroleum fractions may be grouped into three main categories as (a) light distillates, such as liquefied petroleum gas (LPG), gasoline, naphtha; (b) middle distillates, such as, kerosene, diesel; and (c) heavy distillates and residuum, such as heavy fuel oil, lubricating oils, wax, asphalt. These classifications are based on general processes for distilling crude oil and separating into fractions (distillates).

A preferred hydrocarbon feed is selected from the group consisting of jet fuel, kerosene, straight run diesel, light cycle oil, light coker gas oil, gas oil, heavy cycle oil, heavy coker gas oil, heavy gas oil, resid, deasphalted oil, waxes, lubes and combinations of two or more thereof.

Another preferred hydrocarbon feed is a middle distillate blend, which is a mixture of two or more middle distillates, for example, straight run diesel and light cycle oil. By "middle distillates", it is meant the collective petroleum distillation fraction boiling above naphtha (boiling point above about 300° F. or 149° C.) and below residue oil (boiling point above about 800° F. or 427° C.). Middle distillates may be marketed as kerosene, jet fuel, diesel fuel and fuel oils (heating oils).

The diluent, if used, typically comprises, consists essentially of, or consists of a recycle stream of the product effluent from one of the catalyst beds. The recycle stream is a liquid recycle and is a portion of the product effluent of a catalyst bed that is recycled and combined with the hydrocarbon feed before or after contacting the hydrocarbon feed with hydrogen. Preferably the hydrocarbon feed is contacted with the diluent before contacting the hydrocarbon feed with hydrogen.

The liquid feed mixture is introduced into the reactor under "hydroprocessing conditions" which refers to the conditions of elevated temperatures and pressures necessary to achieve the desired hydroprocessing reaction in the catalyst bed. Each catalyst bed has a temperature from about 200° C. to about 450° C., preferably from about 250° C. to about 400° C., more preferably from about 330° C. to about 390° C., and a liquid feed rate to provide a liquid hourly space velocity of from about 0.1 to about 10 hr-1, preferably about 0.4 to about 8.0 hr-1, more preferably about 0.4 to about 6.0 hr-1. Each catalyst bed of the two-phase hydroprocessing zones has a pressure from about 3.45 MPa (34.5 bar) to about 17.3 MPa (173 bar).

As the continuous liquid feed flows down the reactor, it contacts each catalyst bed wherein the hydroprocessing reaction occurs (the "hydroprocessing zone" as it may be referred to herein). The top of the catalyst bed may be covered by a distributor plate to help distribute the liquid feed across the entire bed. The liquid feed fills each catalyst bed such that each catalyst bed is substantially liquid-full. By substantially liquid-full it is meant that, in operation, the catalyst bed is two-phase comprising liquid feed and solid catalyst with substantially no gas phase hydrogen. For beds in which hydrogen gas is injected, "substantially no gas phase hydrogen", means no more than 50%, preferably no more than 10% and more preferably no more than 1% of the hydrogen gas injected into a catalyst bed remains in the gas phase long enough to escape into a headspace.

Hydrogen gas is injected into at least one of the hydroprocessing-catalyst beds. The rate of gas injection is controlled such that hydrogen consumed by the hydroprocessing reaction is replenished and at the same time a substantially liquid phase condition in each catalyst bed is maintained. The hydrogen may be injected into the bed in such manner and at such rate that little, if any, hydrogen gas escapes from the liquid phase in the catalyst bed. Although there may be some instantaneous bubble formation prior to the full dissolution of the hydrogen gas, the feed mixture is substantially liquid phase and the catalyst bed is still substantially liquid-full. The packed catalyst particles help mix the hydrogen as it rises countercurrently in the liquid feed. The hydrogen may be injected into the bed through a bubbler, sparge tube, perforated annular ring or any other suitable means known in the art.

Above each of the catalyst beds is a headspace where any gas escaping from a liquid-full catalyst bed may collect. The upper end of the headspace for a single bed or a first catalyst bed in sequence will generally be defined by the top of the reactor, but need not be and may be any reactor feature designed to collect gas. In the case of a second and other subsequent catalyst bed, the upper end of the headspace for a given bed will generally be defined by the bottom of the preceding catalyst bed, but again need not be and may be any reactor feature designed to collect gas.

The headspace above any or all of the catalyst beds may be equipped with a vent which is able to vent excess gas from the headspace. Each vent may be equipped with a gas valve which can regulate the flow of gas. Herein the term "vent" is used in the singular for convenience but should be understood to include a situation where there may be more than one vent in a given headspace. The gas vented may comprise any one or a plurality of excess hydrogen, light hydrocarbon fractions, and volatile sulfur and nitrogen compounds.

The amount of excess gas in a headspace may be determined, for example, by the position of the liquid level in the catalyst bed below the headspace, from the pressure in the headspace, or any other suitable processes known in the art and any combination thereof. Information on the excess gas in a given headspace including the amount, rate of evolution and hydrogen content, may be used to determine the controlled rate of hydrogen injection into the catalyst bed below that headspace.

Preferably, the total amount of hydrogen vented is not more than 10% and more preferably not more than 5%, on a molar base, of total hydrogen gas injected into the hydroprocessing-catalyst bed(s). The total amount of hydrogen vented refers to the cumulative amount of all hydrogen vented from all headspace vents and the total hydrogen gas injected refers to the cumulative amount of all hydrogen gas injected into all hydroprocessing-catalyst bed(s).

The process of this invention may optionally comprise gas saturators or in-line gas mixers for dissolving hydrogen in the liquid feed before one or more of the beds.

One skilled in the art will appreciate that various reactor configurations are possible with regard to the number of hydroprocessing-beds and choice of hydrogen injection points. For example, in one embodiment of the present invention, the down flow reactor comprises two hydroprocessing-catalyst beds in sequence, a first hydroprocessing-catalyst bed followed by a second hydroprocessing-catalyst bed, and hydrogen is injected into the second catalyst bed.

In another embodiment of the present invention, the down flow reactor comprises three hydroprocessing-catalyst beds in sequence and hydrogen gas is injected into the last hydroprocessing-catalyst bed in the sequence.

In yet another embodiment of the present invention, the down flow reactor comprises three hydroprocessing-catalyst beds in sequence, a first hydroprocessing-catalyst bed followed by a second hydroprocessing-catalyst bed which is followed by a third hydroprocessing-catalyst bed, and hydrogen gas is injected into the second and third hydroprocessing-catalyst beds.

In still another embodiment of the present invention, the down flow reactor comprises two or more hydroprocessing-catalyst beds and hydrogen gas is injected into all of the two or more hydroprocessing-catalyst beds.

Further aspects of the present invention are illustrated in the figures.

DETAILED DESCRIPTION OF THE FIGURES

FIG. 1 illustrates a down flow reactor unit 100 for one embodiment of the process of this invention. Certain detailed features of the present process, such as pumps, compressors, separation equipment, feed tanks, heat exchangers, product recovery vessels and other ancillary process equipment are not shown for the sake of simplicity and in order to demonstrate the main features of the process. Such ancillary features can be easily designed and used by one skilled in the art without any difficulty or undue experimentation.

A liquid feed mixture, formed by contacting hydrocarbon feed with hydrogen and optionally diluent in a mixer, is fed to the top inlet 120 of down flow reactor unit 100. The liquid feed flows downward to contact first catalyst bed 130 and second catalyst bed 150. Liquid level 125 in first bed 130 and liquid level 143 in second bed 150 are set so that beds 130 and 150 are completely liquid-filled. Hydrogen is injected at inlet 133 into first bed 130 and at inlet 152 into second bed 150. The rate of hydrogen injection is controlled by valves 136 and 155. Gas, in excess of its solubility in the liquid feed mixture, collects in headspace 123 above first catalyst bed 130 and in headspace 141 above second catalyst bed 150. The gas in each headspace 123 and 141 is vented through vents 126 and 146, respectively, and the flow of gas through headspace vents 126 and 146 is controlled by valves 128 and 148, respectively. The effluent exits second catalyst bed 150 at outlet 159 the reactor unit 100.

Figure 2:
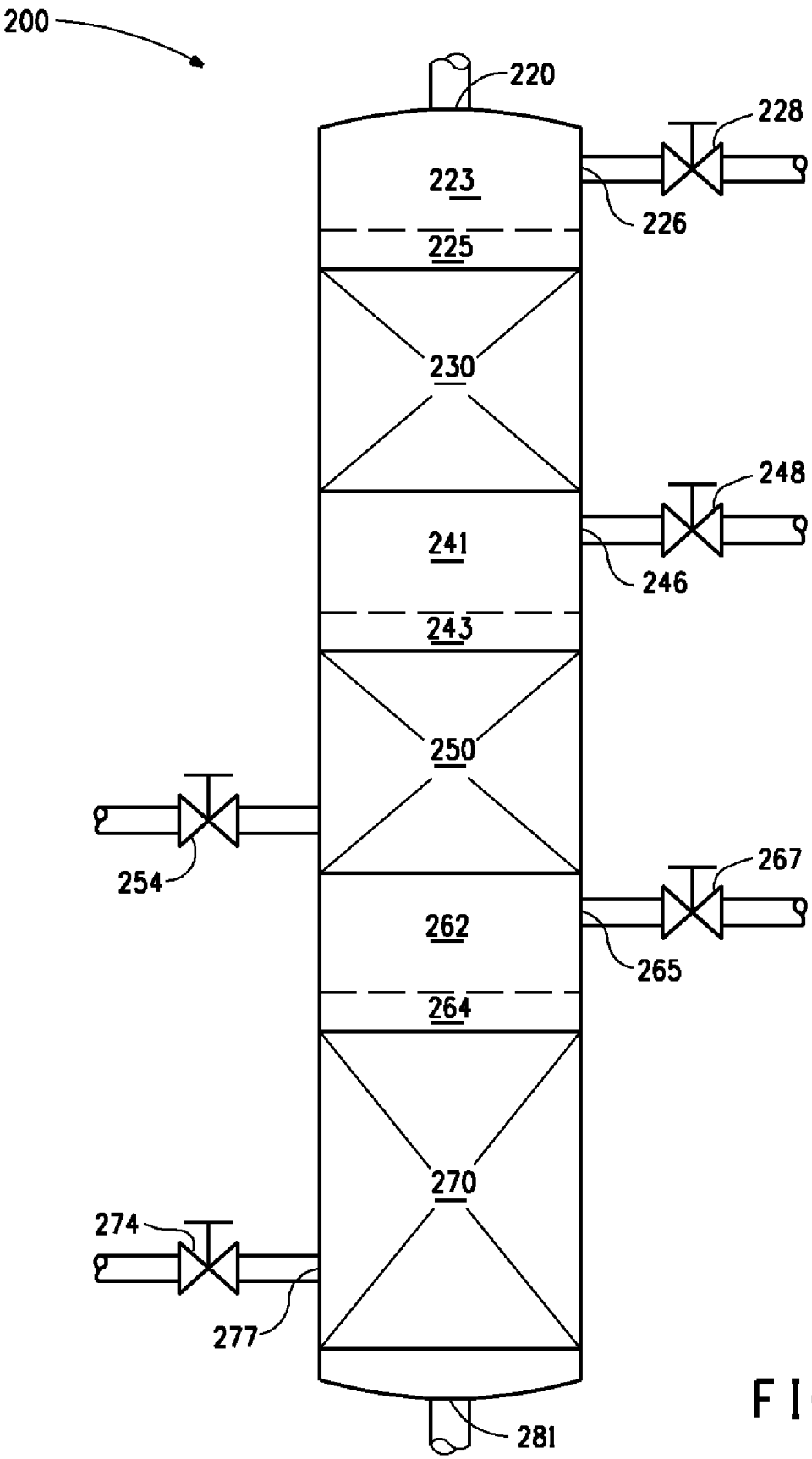
FIG. 2 illustrates a down flow reactor suitable for use in another embodiment of this invention comprising three liquid-full hydroprocessing-catalyst beds.

FIG. 2 illustrates a down flow reactor unit 200 for another embodiment of the process of this invention. As with FIG. 1, some common components are not illustrated for simplicity.

A liquid feed mixture, formed by contacting hydrocarbon feed with hydrogen and diluent (from second reactor 250 through valve 254) in a mixer, is fed through inlet 220 to the top of down flow reactor unit 200. The liquid feed flows downward to contact first catalyst bed 230 and second catalyst bed 250. Liquid level 225 in first bed 230 and liquid level 243 in second bed 250 are set so that beds 230 and 250 are completely liquid-filled. Any excess hydrogen in first bed 230 or second bed 250 may be collected in headspace 223 of first bed 230 or headspace 241 of second bed 250. The gas in each headspace 223 and 241 may be vented through vents 226 and 246. Volume of gas through vents 226 and 246 is controlled by valves 228 and 248, respectively.

Part of the effluent from second catalyst bed 250 is removed through valve 254 as diluent for the liquid feed mixture. The remaining part of the effluent from second bed 250 continues on as feed to third catalyst bed 270. Liquid feed level 264 in third bed 270 completely fills the bed. Hydrogen is injected at inlet 277 into third bed 270 and the rate of hydrogen injection is controlled by valve 274. Gas, in particular any hydrogen gas in excess of its solubility in the liquid feed mixture, collects in headspace 262 above third catalyst bed 270 and is vented through vent 265. The flow of gas through headspace vent 265 is controlled by valve 267. The effluent from second catalyst bed 250 exits at outlet 281 of hydroprocessing reactor unit 200.

EXAMPLES

Analytical Methods and Terms

All ASTM Standards are available from ASTM International, West Conshohocken, Pa.

Amounts of sulfur, and nitrogen are provided in parts per million by weight, wppm.

Total Sulfur was measured using two methods, namely ASTM D4294 (2008), "Standard Test Method for Sulfur in Petroleum and Petroleum Products by Energy Dispersive X-ray Fluorescence Spectrometry," DOI: 10.1520/D4294-08 and ASTM D7220 (2006), "Standard Test Method for Sulfur in Automotive Fuels by Polarization X-ray Fluorescence Spectrometry," DOI: 10.1520/D7220-06

Total Nitrogen was measured using ASTM D4629 (2007), "Standard Test Method for Trace Nitrogen in Liquid Petroleum Hydrocarbons by Syringe/Inlet Oxidative Combustion and Chemiluminescence Detection," DOI: 10.1520/D4629-07 and ASTM D5762 (2005), "Standard Test Method for Nitrogen in Petroleum and Petroleum Products by Boat-Inlet Chemiluminescence," DOI: 10.1520/D5762-05.

Aromatic content was determined using ASTM Standard D5186-03 (2009), "Standard Test Method for Determination of Aromatic Content and Polynuclear Aromatic Content of Diesel Fuels and Aviation Turbine Fuels by Supercritical Fluid Chromatography", DOI: 10.1520/D5186-03R09.

Boiling range distribution was determined using ASTM D2887 (2008), "Standard Test Method for Boiling Range Distribution of Petroleum Fractions by Gas Chromatography," DOI: 10.1520/D2887-08 and ASTM D86 (2009) Standard Test Method for Distillation of Petroleum Products at Atmospheric Pressure," DOI: 10.1520/D0086-09. Boiling points were based on the D86 distillation curve calculated from D2887 data as described D2887.

Density, Specific Gravity and API Gravity were measured using ASTM Standard D4052 (2009), "Standard Test Method for Density, Relative Density, and API Gravity of Liquids by Digital Density Meter," DOI: 10.1520/D4052-09.

"API gravity" refers to American Petroleum Institute gravity, which is a measure of how heavy or light a petroleum liquid is compared to water. If API gravity of a petroleum liquid is greater than 10, it is lighter than water and floats; if less than 10, it is heavier than water and sinks. API gravity is thus an inverse measure of the relative density of a petroleum liquid and the density of water, and is used to compare relative densities of petroleum liquids.

The formula to obtain API gravity of petroleum liquids from specific gravity (SG) is:

$$\text{API gravity}=(141.51/SG)-131.5$$

Bromine Number is a measure of aliphatic unsaturation in petroleum samples. Bromine Number was determined using ASTM Standard D1159, 2007, "Standard Test Method for Bromine Numbers of Petroleum Distillates and Commercial Aliphatic Olefins by Electrometric Titration," DOI: 10.1520/D1159-07.

Cetane Index is a useful calculation to estimate the cetane number (measure of combustion quality of a diesel fuel) of a diesel fuel when a test engine is not available or if sample size is too small to determine this property directly. Cetane Index is determined using ASTM Standard D4737 (2009a), "Standard Test Method for Calculated Cetane Index by Four Variable Equation," DOI: 10.1520/D4737-09a.

"LHSV" means liquid hourly space velocity, which is the volumetric rate of the liquid feed divided by the volume of the catalyst, and is given in $hr^{-1}$.

Refractive Index (RI) was determined using ASTM Standard D1218 (2007), "Standard Test Method for Refractive Index and Refractive Dispersion of Hydrocarbon Liquids," DOI: 10.1520/D1218-02R07.

"WABT" means weighted average bed temperature.

The hydroprocessing unit in these examples comprised a series of four reactors, each constructed of 19 mm (¾") OD 316L stainless steel tubing 49 cm (19¼") in length with reducers to 6 mm (¼") diameter on each end. A desired volume of catalyst was loaded in the mid-section of the reactor and both ends were capped with metal screen to prevent leakage. After the metal mesh, the reactors were packed with 1 mm glass beads at both ends to fill out the remaining volume.

Each reactor was placed in a temperature-controlled sand bath consisting of a 120 cm long steel pipe filled with fine sand having 8.9 cm OD (3" Nominal, Schedule 40). Temperatures were monitored at the inlet and outlet of each reactor and controlled using separate heat tapes wrapped around the 8.9 cm OD sand bath.

The inlets and exits of the reactors were connected with 6-mm OD 316L stainless steel tubing through which the reactants are fed. The effluent form one reactor becomes the feed for the next reactor in sequence. The feed to each reactor was preheated in-line by passage through the sand bath en route to the reactor inlet. Flow through all reactors in all runs is upward.

The following examples are presented to illustrate the present invention and are not to be considered in any way as limiting the scope of the invention.

Control A and Example 1

In this set of examples, the fresh feed was a middle distillate blend (MD1) having the properties shown in TABLE 1. It was prepared by mixing a straight run diesel (SRD, 68 wt. %) sample and a light-cycle oil (LCO, 32 wt. %) sample, both from a commercial refinery.

Reactors R1, R2, R3 and R4 contained 12 mL, 24 mL, 36 mL and 48 mL, respectively, of a hydrotreating catalyst which was KF-860-1.3Q (Ni—Mo on $\gamma$-$Al_2O_3$; Albemarle Corp., Baton Rouge, La.) in the form of quadralobes of 1.3 mm diameter and about 10 mm long.

TABLE 1

Properties of MD1 Feed

| Property | Value | Unit |
|---|---|---|
| Total Sulfur | 11,500 | wppm |
| Total Nitrogen | 290 | wppm |
| Refractive Index | 1.4896 | @20° C. |
| Density at 20° C. | 873.3 | $kg/m^3$ |
| API Gravity | 29.8 | |
| Bromine Number | 2.7 | g/100 g |
| Monoaromatics | 18.7 | wt. % |
| Polyaromatics | 21.4 | wt. % |
| Cetane Index | 43.9 | |
| **Boiling Point** | **Percent** | **° C.** |
| Initial Boiling Point | | 201 |
| | 5 | 238 |
| | 10 | 249 |
| | 20 | 264 |
| | 30 | 276 |
| | 50 | 295 |
| | 70 | 315 |
| | 80 | 325 |
| | 90 | 341 |
| | 95 | 355 |
| Final Boiling Point | | 366 |

The hydrotreating catalyst in the reactors was dried overnight at 115° C. under a total flow of 400 standard cubic centimeters per minute (sccm) of hydrogen gas. The reactors were heated to 176° C. with flow of charcoal lighter fluid (CLF) through the catalyst beds. Sulfur spiked-CLF (1 wt % sulfur, added as 1-dodecanethiol) and hydrogen gas were passed through the reactors at 176° C. to pre-sulfide the catalyst. The pressure was 6.9 MPa (1000 psig, 69 bar).

The temperature of the reactors was increased gradually to 320° C. Pre-sulfiding was continued at 320° C. until breakthrough of hydrogen sulfide ($H_2S$) was observed at the outlet of R4. After pre-sulfiding, the catalysts were stabilized by flowing a straight run diesel (SRD) through the catalysts in the reactors at a temperature varying from 320° C. to 355° C. and at pressure of 6.9 MPa (1000 psig, 69 bar) for approximately 10 hours.

With the catalyst pre-sulfided and stabilized, the temperature in each the reactors was brought to 349° C. to conduct the hydroprocessing reaction.

A positive displacement pump provided fresh feed to R1 at a flow rate of 4.0 mL/min. which amounts to an overall liquid-hourly space velocity (LHSV) of 2 $hr^{-1}$ through the hydroprocessing zone. The hydroprocessing zone is the volume of reactor space occupied by the catalyst (in this case, 120 mL total catalyst across four reactors).

In Control A, the effluent from R4 was split into a liquid recycle stream and a final product stream. The liquid recycle stream flowed through a piston metering pump and was combined with the fresh feed going to the inlet of R1. Control A, employed a recycle ratio (volume of liquid recycle stream to volume of fresh feed) of 2. Example 1 employed no recycle, but otherwise used the same conditions as Control A.

Hydrogen was injected into the feed stream prior to each of the four reactors. Hydrogen was fed from compressed gas cylinders and the flow was measured using dedicated mass flow controllers. The total hydrogen feed rate was 107 normal liters of hydrogen gas per liter of fresh feed (NL/L) (600 scf/bbl). The pressure at the inlet to R1 was nominally 8.27 MPa (1200 psia, 82.7 bar).

The catalyst volumes were chosen so that the amount of hydrogen consumed in each reactor was about the same, although the hydrogen consumption in the reactor is, by design, not complete and some hydrogen exits the reactors in the liquid stream. About an equal amount of hydrogen was injected into each of Reactors 2-4 to replenish the hydrogen consumed. The amount of hydrogen injected into the first reactor is somewhat greater than the other three as the fresh feed to R1 contains no residual hydrogen.

In Control A, and in all Control runs herein, the amount of hydrogen injected at each point is just enough to saturate or re-saturate the hydrocarbon feed stream as the stream enters each reactor. This simulates standard liquid-full hydroprocessing conditions. In contrast, Example 1, and in the all Example runs herein, the same amount of hydrogen is used as the Control run in the set, but no recycle or less recycle is used, so that the hydrogen exceeds the saturation point and gaseous hydrogen enters the reactors along with the hydrogen-saturated liquid stream. This simulates injection of gaseous hydrogen into the bed as prescribed in the present invention. The gaseous hydrogen rapidly dissolves in the hydrocarbon as the hydroprocessing reaction proceeds and at the reactor exit the stream is substantially liquid phase as defined herein.

Reaction conditions were maintained for at least 24 hours in all runs to achieve steady state. The final reactor output was tested periodically for total sulfur, nitrogen, density, and off-gas flow rate.

At steady state, the final product was flashed, cooled, and separated into gas and liquid product streams. A total liquid product (TLP) sample and an off-gas sample were collected for each run. The sulfur and nitrogen contents as well as the density and refractive index were measured in the TLP sample and overall material as well as sulfur, nitrogen, and hydrogen balances were calculated by using a GC-FID to account for light ends in the off-gas. The hydrogen consumption was calculated from the difference in total hydrogen feed and hydrogen found in the off-gas.

The upflow reactor design used in the Examples was a matter of convenience for lab-scale operation. The design provided representative results that would be obtained from a down flow reactor which is prescribed by the present invention and preferred for commercial operation. The feed to all reactors in Example 1 comprises a combination of gaseous hydrogen and hydrogen-saturated liquid hydrocarbon feed which simulates conditions prescribed by present invention wherein hydrogen is injected at a controlled rate directly into all the catalyst beds.

Results for Example 1 and Control A are shown in TABLE 2.

TABLE 2

Results for Example 1 and Control A

| | Control A Results | Example 1 Results | MD 1 Feed |
|---|---|---|---|
| LHSV $hr^{-1}$ | 2.0 | 2.0 | |
| Liquid RR | 2 | 0 | |
| WABT (° C.) | 349 | 349 | |
| P (MPa) | 8.27 | 8.27 | |
| S (ppm) | 442 | 46 | 11,500 |
| N (ppm) | 5 | 1 | 290 |
| Density ($kg/m^3$, 20° C.) | 851 | 847 | 873 |
| Refractive Index | 1.4749 | 1.4730 | 1.4896 |
| Cetane Index | 49.6 | 50.2 | 43.8 |
| $H_2$ cons (NL/L) | 80 | 91 | |

As can be seen from TABLE 2, beneficial results of Example 1, with hydrogen injection, relative to Control A, with all hydrogen is dissolved in the feed, include low/no recycle, lower sulfur and nitrogen content of TLP, lower density of the TLP, higher cetane index, and higher hydrogen consumption ($H_2$ cons). Hydrogen injection as prescribed by the present invention improves the hydrotreating efficiency of a reactor system.

Control B and Example 2

These runs were conducted as described for Control A/Example 1, except as noted. The fresh feed was a SRD sample (SRD1) from a commercial refinery having the properties shown in TABLE 3.

Reactors R1, R2, R3 and R4 contained 10 ml, 40 ml, 60 ml and 130 mL, respectively, of hydrotreating catalyst which was KF-868-1.3Q (Ni—Mo on $\gamma$-$Al_2O_3$ from Albemarle Corp., Baton Rouge, La.) in the form of quadralobes of 1.3 mm diameter and about 10 mm long. The catalyst was dried, sulfided, and stabilized as described previously.

The SRD fresh feed flow rate was 4.0 mL/min which, in this case, amounts to an LHSV of 1.0 $hr^{-1}$. The total hydrogen feed rate was 53 NL/L (300 scf/bbl). The pressure at the inlet to R1 was kept constant at 7.0 MPa (1,015 psia, 70 bar). The WABT was maintained at 321° C. The recycle ratio was 6.0 for the Control B; there was no recycle in Example 2.

TABLE 3

Properties of SRD1 Feed

| Property | Value | Unit |
|---|---|---|
| Total Sulfur | 9,000 | wppm |
| Total Nitrogen | 100 | wppm |
| Refractive Index | 1.4780 | @20° C. |
| Density at 20° C. | 859.7 | $kg/m^3$ |
| API Gravity | 32.3 | |
| Bromine Number | 1.9 | g/100 g |
| Monoaromatics | 18.4 | wt. % |
| Polyaromatics | 8.6 | wt. % |
| Cetane Index | 52.9 | |
| **Boiling Point** | **Percent** | **° C.** |
| Initial Boiling Point | | 228 |
| | 5 | 260 |
| | 10 | 274 |
| | 20 | 287 |
| | 30 | 298 |
| | 50 | 307 |
| | 70 | 317 |
| | 80 | 321 |
| | 90 | 329 |
| | 95 | 336 |
| Final Boiling Point | | 344 |

The feed in Example 2 comprises a combination of gaseous hydrogen and hydrogen-saturated liquid hydrocarbon feed, again simulating the conditions prescribed by present invention wherein hydrogen is injected at a controlled rate directly into the catalyst beds. The results for these runs at steady state are shown in TABLE 4.

TABLE 4

Results for Example 2 and Control B

| | Control B Results | Example 2 Results | SRD1 Feed |
|---|---|---|---|
| LHSV $hr^{-1}$ | 1.0 | 1.0 | |
| Liquid RR | 6 | 0 | |
| WABT (° C.) | 321 | 321 | |
| P (MPa) | 7.0 | 7.0 | |
| S (ppm) | 633 | 62 | 9,000 |
| N (ppm) | 5 | 1 | 100 |
| Density ($kg/m^3$, 20° C.) | 848 | 845 | 860 |
| Refractive Index | 1.4704 | 1.4689 | 1.4780 |
| Cetane Index | 56.0 | 58.4 | 52.9 |
| $H_2$ cons (NL/L) | 36 | 40 | |

As can be seen from TABLE 4, beneficial results for Example 2, with hydrogen injection, relative to Control B, with all hydrogen dissolved in the feed, include low/no recycle, lower sulfur and nitrogen content of TLP, lower density of the TLP, higher cetane index, and higher hydrogen consumption ($H_2$ cons).

Control C and Example 3

These runs were conducted as described for Control A/Example 1, except as noted. The fresh feed was a middle distillate (MD2) feed sample obtained as natural gas liquids from a commercial operation, having the properties shown in TABLE 5.

TABLE 5

Properties of MD2 Feed

| Property | Value | Unit |
|---|---|---|
| Total Sulfur | 440 | wppm |
| Total Nitrogen | 50 | wppm |
| Refractive Index | 1.4582 | @20° C. |
| Density at 20° C. | 819.1 | $kg/m^3$ |
| API Gravity | 40.4 | 15.5° C. |
| Bromine Number | <0.5 | g/100 g |
| Monoaromatics | 19 | wt. % |
| Polyaromatics | 5 | wt. % |
| Cetane Index | 49.1 | |

| Boiling Point | Percent | ° C. |
|---|---|---|
| Initial Boiling Point | | 140 |
| | 5 | 147 |
| | 10 | 160 |
| | 20 | 182 |
| | 30 | 203 |
| | 50 | 242 |
| | 70 | 278 |
| | 80 | 299 |
| | 90 | 326 |
| | 95 | 348 |
| Final Boiling Point | | 366 |

In this set of runs, only two of the four reactors were used. Reactors R1 and R2 contained 40 mL, and 80 mL, respectively, of hydrotreating catalyst which was KF-767-1.3Q (Co—Mo on $\gamma$-$Al_2O_3$ from Albemarle Corp., Baton Rouge, La.) in the form of quadralobes of 1.3 mm diameter and about 10 mm long. The catalyst was dried, sulfided, and stabilized as described previously.

The MD2 fresh feed flow rate was 3.0 mL/min which amounts to an LHSV of 1.5 $hr^{-1}$. The total hydrogen feed rate was 29 NL/L (165 scf/bbl). The pressure at the inlet to R1 was kept constant at 4.76 MPa (690 psia, 47.6 bar). The WABT was maintained at 321° C. The recycle ratio was 1.0 for Control C; there was no recycle in Example 3.

The feed in Example 3 comprised a combination of gaseous hydrogen and hydrogen-saturated liquid hydrocarbon feed, again simulating the conditions prescribed by present invention wherein hydrogen is injected at a controlled rate directly into the catalyst bed. The results at steady state for these runs are shown in TABLE 6.

TABLE 6

Results for Example 3 and Control C

| | Control C Results | Example 3 Results | MD2 Feed |
|---|---|---|---|
| LHSV $hr^{-1}$ | 1.5 | 1.5 | |
| Liquid RR | 1 | 0 | |
| WABT (° C.) | 321 | 321 | |
| P (MPa) | 4.76 | 4.76 | |
| S (ppm) | 16 | 10 | 440 |
| N (ppm) | 4 | 0 | 50 |
| Density ($kg/m^3$, 20° C.) | 816 | 815 | 819 |
| Refractive Index | 1.4554 | 1.4540 | 1.4582 |
| Cetane Index | 49.6 | 49.8 | 49.1 |
| $H_2$ cons (NL/L) | 19 | 21 | |

As can be seen from TABLE 6, beneficial results for Example 3 with hydrogen injection, relative to Control C with all hydrogen dissolved in the feed, include low/no recycle, lower sulfur and nitrogen content of TLP, lower density of the TLP, higher cetane index, and higher hydrogen consumption.

Control D and Example 4

These runs were conducted as described for Control A/Example 1, except as noted. The fresh feed was a new SRD feed sample (SRD2), having the properties shown in TABLE 7.

TABLE 7

Properties of SRD2 Feed

| Property | Unit | Value |
|---|---|---|
| Total Sulfur | 6,765 | wppm |
| Total Nitrogen | 86 | wppm |
| Refractive Index | 1.4737 | @20° C. |
| Density at 20° C. | 849.4 | $kg/m^3$ |
| API Gravity | 34.3 | |
| Bromine Number | 1.7 | g/100 g |
| Monoaromatics | 24.4 | wt. % |
| Polyaromatics | 7.9 | wt. % |
| Cetane Index | 51.5 | |

| Boiling Point | Percent | ° C. |
|---|---|---|
| Initial Boiling Point | | 203 |
| | 5 | 239 |
| | 10 | 252 |
| | 20 | 265 |
| | 30 | 275 |
| | 50 | 285 |
| | 70 | 298 |
| | 80 | 305 |
| | 90 | 318 |
| | 95 | 328 |
| Final Boiling Point | | 339 |

Reactors R1, R2, R3 and R4 contained 12 mL, 24 mL, 36 mL and 48 mL, respectively, of hydrotreating catalyst which was KF-848-1.3Q (Ni—Mo on $\gamma$-$Al_2O_3$; Albemarle Corp., Baton Rouge, La.) in the form of quadralobes of 1.3 mm diameter and about 10 mm long. The catalyst was dried, sulfided, and stabilized as described previously.

The feed in Examples 4a-c comprised a combination of gaseous hydrogen and hydrogen-saturated liquid hydrocarbon feed, again simulating the conditions prescribed by present invention wherein hydrogen is injected at a controlled rate directly into the catalyst beds.

The SRD2 fresh feed flow rate was 4.0 mL/min which amounted to an LHSV of 2.0 $hr^{-1}$. The total hydrogen feed rate was 71 N L/L (400 scf/bbl). The pressure at the inlet to R1 was kept constant at 7.0 MPa (1,015 psia, 70 bar). The WABT was maintained at 354° C. The recycle ratio was 6.5 for Control D. There was a recycle ratio of 5.5 in Example 4a; a recycle ratio of 4.0 in Example 4b, and no recycle in Example 4c.

The results at steady state for these runs are shown in TABLE 8.

TABLE 8

| | Control D Results | Ex. 4a Results | Ex. 4b Results | Ex. 4c Results | SRD2 Feed |
|---|---|---|---|---|---|
| LHSV $hr^{-1}$ | 2.0 | 2.0 | 2.0 | 2.0 | |
| Liquid RR | 6.5 | 5.5 | 4.0 | 0 | |
| WABT (° C.) | 354 | 354 | 354 | 354 | |
| P (MPa) | 7.0 | 7.0 | 7.0 | 7.0 | |
| S (ppm) | 65 | 40 | 30 | 7 | 6765 |
| N (ppm) | 2.5 | 2.2 | 1.5 | 0.4 | 86 |
| Density (kg/$m^3$, 20° C.) | 834 | 833 | 832 | 831 | 849 |
| Refractive Index | 1.4724 | 1.4721 | 1.4617 | 1.4607 | 1.4737 |
| Cetane Index | 57.4 | 57.6 | 57.6 | 57.8 | 51.5 |
| $H_2$ cons (NL/L)) | 58.6 | 59.8 | 61.8 | 62.3 | |

As can be seen from TABLE 8, beneficial results of Examples 4a-4-c with hydrogen injection, relative to Control D with all hydrogen dissolved in the feed, are seen at all levels of recycle in Example 4a-c but especially at the lowest recycle level (Example 4c), lower sulfur.

Control E and Example 5

These runs were conducted as described for Control A/Example 1, except as noted. The fresh feed was SRD2 having the properties shown in Table 7.

Reactors R1, R2, and R3, each contained 60 ml, of a hydrotreating catalyst which was KF-767-1.3Q (Co—Mo on $\gamma$-$Al_2O_3$ from Albemarle Corp., Baton Rouge, La.) in the form of quadralobes of 1.3 mm diameter and about 10 mm long. The catalyst was dried, sulfided, and stabilized as described previously.

In Control E, the recycle was taken from the effluent of R3 which was split into a liquid recycle stream and a final product stream. In Example 5, a recycle stream was taken from the effluent of R2 which was split into a liquid recycle stream and an effluent stream. The effluent stream from R2 then served as the feed (with no recycle) to R3 and the total effluent from R3 was taken as the product stream of Example 5.

The SRD fresh feed flow rate was 4.0 mL/min which, in this case, amounts to an LHSV of 1.3 $hr^{-1}$. The total hydrogen feed rate was 45 NL/L (250 scf/bbl). The pressure at the inlet to R1 was kept constant at 7.0 MPa (1,015 psia, 70 bar). The WABT was maintained at 338° C. The recycle ratio was 4.0 for the Control E; in Example 5, R1 and R2 had a recycle ratio of 4.0, but R5 had no (zero) recycle.

The feed in Example 5 comprises a combination of gaseous hydrogen and hydrogen-saturated liquid hydrocarbon feed in R3 only, simulating the condition prescribed by present invention wherein hydrogen is injected at a controlled rate directly into only one the catalyst beds.

The results at steady state for these runs are shown in TABLE 9.

TABLE 9

| | Control E Results | Example 5 Results | SRD2 Feed |
|---|---|---|---|
| LHSV $hr^{-1}$ | 1.3 | 1.3 | |
| Liquid RR | 4.0 | 4.0/0 | |
| WABT (° C.) | 338 | 338 | |
| P (MPa) | 7.0 | 7.0 | |
| S (ppm) | 398 | 265 | 6765 |
| N (ppm) | 5.2 | 2.0 | 86 |
| Density (kg/$m^3$, 20° C.) | 841 | 840 | 849 |
| Refractive Index | 1.4676 | 1.4675 | 1.4737 |
| Cetane Index | 56.2 | 56.3 | 51.5 |
| $H_2$ cons (NL/L) | 35.7 | 36.0 | |

As can be seen from TABLE 9, beneficial results for Example 5 with hydrogen injection, relative to Control E with all hydrogen dissolved in the feed, are achieved but are not as great as when hydrogen is injected into all the beds.

What is claimed is:

1. A hydroprocessing process comprising:

(a) providing a down flow reactor comprising one or more hydroprocessing-catalyst beds and providing when two or more hydroprocessing-catalyst beds are present that said beds are disposed in sequence and in liquid communication;

(b) contacting a hydrocarbon feed with hydrogen and optionally diluent to form a liquid feed mixture wherein hydrogen is dissolved in the mixture;

(c) introducing said liquid feed mixture into the down flow reactor under hydroprocessing conditions;

(d) reacting the liquid feed mixture by contact with the one or more hydroprocessing-catalyst beds, wherein each of said one or more hydroprocessing-catalyst beds is substantially liquid-full;

(e) injecting hydrogen gas directly into at least one of the one or more hydroprocessing-catalyst beds at a controlled rate such that at least part of the hydrogen consumed in each bed by the hydroprocessing reaction is replenished and the substantially liquid-full condition in each hydroprocessing-catalyst bed is maintained; and (f) adjusting the controlled rate of hydrogen gas directly injected into at least one of the one or more hydroprocessing-catalyst beds based on the amount of hydrogen gas determined to be in a headspace above said at least one of the one or more hydroprocessing-catalyst beds.

2. The process of claim 1 further comprising venting excess gas from a headspace above at least one of the one or more hydroprocessing-catalyst beds.

3. The process of claim 2 wherein the total amount of hydrogen gas vented is not more than 10%, on a molar basis, of total hydrogen gas directly injected into the one or more hydroprocessing-catalyst bed(s).

4. The process of claim 2 wherein the total amount of hydrogen gas vented is not more than 5%, on a molar base, of total hydrogen gas directly injected into the one or more hydroprocessing-catalyst bed(s).

5. The process of claim 1 wherein the down flow reactor comprises two or more hydroprocessing-catalyst beds and hydrogen gas is directly injected into all of the two or more hydroprocessing-catalyst beds.

6. The process of claim 1 wherein the down flow reactor comprises two or more hvdroprocessing-catalyst beds, each catalyst bed has a catalyst volume, and the catalyst volume increases with each succeeding bed.

7. The process of claim 6 wherein the hydrogen consumption in each catalyst bed is about the same.

8. The process of claim 1 wherein no more than 10% of the hydrogen gas directly injected into the at least one of the one or more hydroprocessing-catalyst beds remains in the gas phase long enough to escape into a headspace above the at least one of the one or more hydroprocessing-catalyst beds.

9. The process of claim 1 wherein no more than 1% of the hydrogen gas directly injected into the at least one of the one or more hydroprocessina-catalyst beds remains in the gas phase long enough to escape into a headspace above the at least one of the one or more hydroprocessing-catalyst beds.

10. The process of claim 1, wherein the liquid feed mixture comprises diluent and the volume ratio of diluent to liquid hydrocarbon feed is less than about 5.

11. The process of claim 1, wherein the liquid feed mixture comprises diluent and the volume ratio of diluent to liquid hydrocarbon is less than 1.

12. The process of claim 1 wherein the liquid feed mixture comprises diluent and the volume ratio of diluent to liquid hydrocarbon is less than 0.5.

13. The process of claim 10 wherein the diluent is recycled effluent from one of the hydroprocessing-catalyst beds.

14. The process of claim 11 wherein the diluent is recycled effluent from one of the hydroprocessing-catalyst beds.

15. The process of claim 12 wherein the diluent is recycled effluent from one of the hydroprocessing-catalyst beds.

16. The process of claim 1 wherein no diluent is present.

17. The process of claim 1 wherein the hydrogen gas is injected directly into at least one of the one or more hydroprocessing-catalyst beds through a bubbler, a sparge tube, or a perforated annular ring.

18. The process of claim 1 wherein more than one catalyst bed is present, each catalyst bed has a catalyst volume, and the catalyst volume increases with each succeeding bed.

19. The process of claim 18 wherein the hydrogen consumption in each catalyst bed is about the same.

* * * * *